US007661814B2

(12) United States Patent
Noe et al.

(10) Patent No.: US 7,661,814 B2
(45) Date of Patent: Feb. 16, 2010

(54) HAND HELD MICRO-FLUID EJECTION DEVICES CONFIGURED TO BLOCK PRINTING BASED ON PRINTER ORIENTATION AND METHOD OF BLOCKING

(75) Inventors: Gary Lee Noe, Lexington, KY (US); William Henry Reed, Lexington, KY (US); Douglas Laurence Robertson, Lexington, KY (US); Barry Baxter Stout, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 409 days.

(21) Appl. No.: 11/459,971

(22) Filed: Jul. 26, 2006

(65) Prior Publication Data

US 2008/0024583 A1 Jan. 31, 2008

(51) Int. Cl.
*B41J 3/36* (2006.01)

(52) U.S. Cl. ..... 347/109; 347/108; 347/14

(58) Field of Classification Search ..... 347/14, 347/19, 9, 8, 15, 109, 108
See application file for complete search history.

(56) References Cited

U.S. PATENT DOCUMENTS 6,854,821 B2 * 2/2005 Ericson et al. ..... 347/14
2002/0154186 A1 * 10/2002 Matsumoto ..... 347/14

* cited by examiner

*Primary Examiner*—Manish S Shah

(57) ABSTRACT

A hand-held micro-fluid ejection device for ejecting a fluid onto a substrate surface in a plurality of physical orientations between the ejection device and a substrate surface, and methods for controlling the geometric accuracy of printing using a hand-held printing apparatus. Various spatial and dynamic orientations of the ejection device are measured, such as rotation angle, yaw angle, and velocity and acceleration vectors. Threshold limits are established for the orientations and printing is disabled if the measured values exceed the threshold limits.

4 Claims, 3 Drawing Sheets

HAND HELD MICRO-FLUID EJECTION DEVICES CONFIGURED TO BLOCK PRINTING BASED ON PRINTER ORIENTATION AND METHOD OF BLOCKING

TECHNICAL FIELD

The disclosure relates to the field of micro-fluid ejection devices. More particularly, the disclosure relates to hand-held devices for ejecting fluids onto surfaces that are physically substantially unengaged with the micro-fluid ejection device.

BACKGROUND AND SUMMARY

It may be desirable to provide a micro-fluid ejection device, for example, a printer, that is manually positioned over a media or substrate surface (such as a piece of paper, cardboard, cloth, wood, plastic, film, or similar material). The device may then be activated to eject fluid, such as ink, to provide text or graphical information on that surface. Ejection of ink in the manner described above is analogous to airbrush painting except that the pattern of ink from the ejection device is controlled to produce textual or graphic images instead of the simple spray "dot" or lines produced by an airbrush device. In such applications the ejection device is generally substantially physically unengaged from the media or substrate on which the fluid is deposited. In other words, the physical location, orientation, and motion of the surface and micro-fluid ejection device with respect to each other are not mechanically controlled either by the ejection device or by an external mechanism.

As used herein the term "orientation" refers to both spatial and dynamic orientations. A spatial orientation is a geometric orientation between an ejection head and a substrate surface irrespective of whether there is relative translational or elevational motion between the ejection head and the substrate surface. A dynamic orientation is a kinetic relationship between an ejection head and a substrate surface. A dynamic orientation is defined at least in part by a vector having a magnitude and a direction. The magnitude and the direction of vectors are each separately considered herein to be an element of orientation between an ejection head and a substrate surface. The dynamic orientation may represent a relative velocity or a relative acceleration between the ejection head and the substrate surface.

In order to compensate for the mechanical dissociation between the ejection device and the surface, one or more optical sensors may be incorporated into the ejection device to track the relative motion of the device as it moves over the surface of the material onto which the fluid is ejected. The foregoing is analogous to the tracking provided by an optical mouse in a computer system. Referential position information regarding the location of the ejection device with respect to substrate surface is provided by the optical sensor to the ejection device, and control circuitry in the ejection device uses this positional data to assist the user in determining when to eject fluid as the ejection device moves over the surface of the substrate.

While these hand-held micro-fluid ejection devices typically sense position over the substrate surface and may automatically determine when an area traversed should be imprinted, the motion of these devices is controlled by the operator whose motion may be random, irregular, and inconsistent. Such unpredictable motion contrasts sharply with traditional printers where motion is precisely controlled, so the hand-held design has unique challenges in compensating for the motion of the operator to maintain quality of the imprinted image. What are needed are apparatuses and methods for dealing with operator motion that exceeds desired design limits. Examples include: print motion outside optimal speed; excessive rotation or acceleration; excessive yaw angle; and separation of the ejection head from the substrate surface.

Exemplary embodiments of the disclosure provide a hand-held micro-fluid ejection device for ejecting a fluid onto a substrate surface in a plurality of physical orientations between the ejection device and a substrate surface. The device typically incorporates an ejection head that has an enabled state for permitting the ejection of the fluid onto the substrate surface and a disabled state for blocking the ejection of the fluid onto the substrate surface. A position sensor system is typically included. The position sensor system is configured to provide measured data indicative of an actual orientation between the ejection device and the substrate surface. Generally an electronic processor is provided, and the electronic processor is configured to receive the measured data from the position sensor system and configured to place the ejection head in the disabled state if the measured data indicates that the actual orientation of the ejection device exceeds a threshold limit for the orientation between the ejection device and the substrate surface.

Some embodiments provide a hand-held micro-fluid ejection device for ejecting a fluid onto a target area of a substrate surface that includes an ejection head that has an enabled state for permitting the ejection of the fluid onto the substrate surface and a disabled state for blocking the ejection of the fluid onto the substrate surface. A position sensor system is provided, and the position sensor system is configured to provide measured data indicative of a location of the ejection device with respect to the target area of the substrate surface. An electronic processor is included, and the electronic processor is configured to receive the measured data from the position sensor system and configured to place the ejection head in the disabled state if the measured data indicates that the location of the ejection device is not within the target area.

Methods are provided for controlling the geometric accuracy of printing using a hand-held printing apparatus. In exemplary applications the method includes a step of acquiring in the printing apparatus at least one threshold limit representing a maximum value for an orientation parameter affecting the spatial accuracy of printing on a target area of a printing surface. The method generally further includes a step of sensing a print signal that if positive indicates an operator's instruction to print a portion of an image using the printing apparatus, and a step of sensing an orientation of the printing apparatus relative to the target area of the printing surface. The method typically further includes a step of disabling the printing by the printing apparatus if the orientation of the printing apparatus relative to the target area of the printing surface exceeds the threshold limit when the print signal is positive.

BRIEF DESCRIPTION OF THE DRAWINGS

Various features and advantages may be exemplified by reference to the detailed description in conjunction with the figures, wherein elements are not to scale so as to more clearly show the details, wherein like reference numbers indicate like elements throughout the several views, and wherein.

DETAILED DESCRIPTION OF EXEMPLARY EMBODIMENTS

Described herein are various embodiments of a hand-held micro-fluid ejection device for ejecting a fluid onto a substrate surface in a plurality of physical orientations. Also described herein is a method for controlling the geometric accuracy of fluid ejection using a hand-held micro-fluid ejection apparatus.

As used herein, the term "hand-held" means that the relative translational motion between the substrate surface and the micro-fluid ejection device is at least in part continuously manually controlled by a human operator rather than by a mechanical device.

As used herein, the term "relative translational motion" generally refers to an arrangement where the substrate surface remains substantially stationary relative to a fixed external frame of reference while the micro-fluid ejection device is moved over the target area of the substrate surface during fluid ejection. However, in some embodiments the ejection device remains substantially stationary relative to a fixed external frame of reference while the target area of the substrate surface moves relative to the ejection device. In some embodiments both the substrate surface and the ejection device may move relative a fixed external frame of reference.

It should also be noted that a distance between the substrate surface and the micro-fluid ejection device may vary in the direction orthogonal to the translational motion between the substrate surface and the ejection device. In a hand-held micro-fluid ejection device this gap between the substrate surface and the ejection device may be mechanically controlled (such as by a fixed dimension spacer) or the gap may be under continuous manual control of the operator. The term "relative elevational motion" refers to motion between the ejection device and the substrate surface in the direction orthogonal to the relative translational motion.

In order to simplify the discussion and provide illustrations of the apparatus and use thereof according to the disclosed embodiments, the following discussion is directed to a micro-fluid ejection device that is a handheld printing device for ejecting ink onto a substrate or media. It will be appreciated that the disclosure is specifically directed to "micro-fluid ejection devices," however, the principles and methods described herein may be applied to all pattern imprinting mechanisms including, but not limited to inkjet printers, bubblejet printers, thermal printers (both direct and transfer), electrochromic printers, erosion printers, and so forth. It will be further appreciated that the exemplary embodiments may be applied to any handheld micro-fluid ejection device, such as devices used for ejecting cooling fluids, lubricants, pharmaceuticals, and the like on a wide variety of surfaces.

Figure 1:
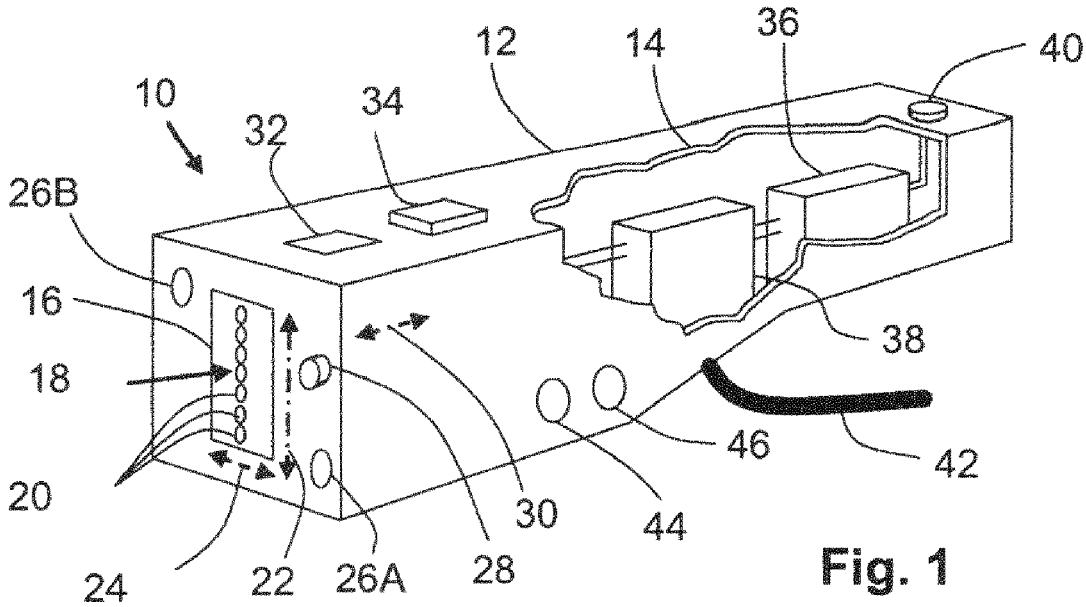
FIG. 1 is a schematic perspective of a hand-held micro-fluid ejection device.

FIG. 1 illustrates an embodiment of a hand-held printing apparatus 10. The printing apparatus 10 has a housing 12, and a cut-away window 14 is depicted in the housing 12 only for illustrative purposes in order to portray certain components inside the housing 12. The printing apparatus 10 has a micro-fluid ejection head 16. The ejection head 16 has a linear array 18 of micro-fluid ejection ports or nozzles 20. The linear array 18 has a longitudinal orientation depicted by reference arrow 22 and an orthogonal lateral alignment line depicted by reference arrow 24.

"Translational motion" of the printing apparatus 10 refers to motion in the either the direction of reference arrow 22 or reference arrow 24 or combinations of those directions. The printing apparatus 10 also contains two position sensors 26A and 26B that may be used to provide positional data regarding the position and translational motion of the printing apparatus 10. In some embodiments position sensors 26A and 26B may be combined into a single position sensor, but employing two position sensors having a spatial separation may be beneficial for detecting rotation of micro-fluid ejection head 16 in the plane established by reference arrows 22 and 24.

The printing apparatus 10 may also include a proximity sensor 28 that measures a gap between the printing apparatus 10 and a printing surface. That is, when the printing apparatus 10 is proximate to a printing surface, the proximity sensor 28 measures displacement of the ejection head 16 from the printing surface in the direction of reference arrow 30 (which is orthogonal to the plane established by reference arrows 22 and 24). A configuration of a printing apparatus (e.g., the printing apparatus 10) that is configured with a position sensor 26A, or with a position sensor 26B, or with a proximity sensor 28, or that is configured with a combination of these sensors, is referred to herein as a printing apparatus with a position sensor system.

The printing apparatus 10 may include a display 32 and a "PRINT" button 34 for activating the printing apparatus 10. The display 32 may be used to portray information regarding the image to be printed or a portion thereof, or to portray the status of the printer, or combinations of the foregoing and similar information. The PRINT button 34 may be pressed to provide a print enable signal to the printing apparatus 10 to place ejection head 16 in an enabled state thereby permitting fluid to be ejected from the ejection head 16 through the nozzles 20. The PRINT button 34 is may be released to remove the print enable signal and place ejection head 16 in a disabled state for blocking the ejection of the fluid.

In one exemplary embodiment, the housing 12 of the printing apparatus 10 may include a power supply 36 and an electronic processor 38. The electronic processor 38 is typically configured to receive measured data from the position sensor system (e.g., position sensor /26A, position sensor 26B, and proximity sensor 28). As used herein, the term "configured to receive" refers to direct or indirect receipt of suitable signals between two elements (e.g., the electronic processor 38 and the position sensor system (e.g., 26A, 26B and 28), either directly or indirectly through one or more intermediate elements, to establish the stated configuration (e.g., the measured data are in the electronic processor).

The electronic processor is further typically configured to place the ejection head 16 in an enabled state or a disabled state depending on the measured data. As used herein, the term "configured to place" refers to direct or indirect transmission of suitable signals between two elements (e.g., the electronic processor 38 and the ejection head 16), either directly or indirectly through one or more intermediate elements, to establish the stated configuration (e.g., the ejection head is in the enabled state or in the disabled state). It is to be understood that placing ejection head 16 in an enabled state or a disabled state may not result in any configuration change in ejection head 16. For example, placing ejection head 16 in an enabled state or in a disabled state may involve setting a condition in the electronic processor 38 (or in another element such as firmware or in software) that enables or disables fluid ejection only.

An on/off button 40 may be provided, and a communication link 42 may be provided to transfer information to be printed from an external source such as a computer or personal digital assistant (PDA) device. Communication link 42 is portrayed in FIG. 1 as a wired link, but in alternative embodiments a wireless communication link may be use. Two print control dials 44 and 46 may be provided for the user of printing apparatus 10 to control various aspects of the printed image such as quality mode, color, and the like.

Figure 2:
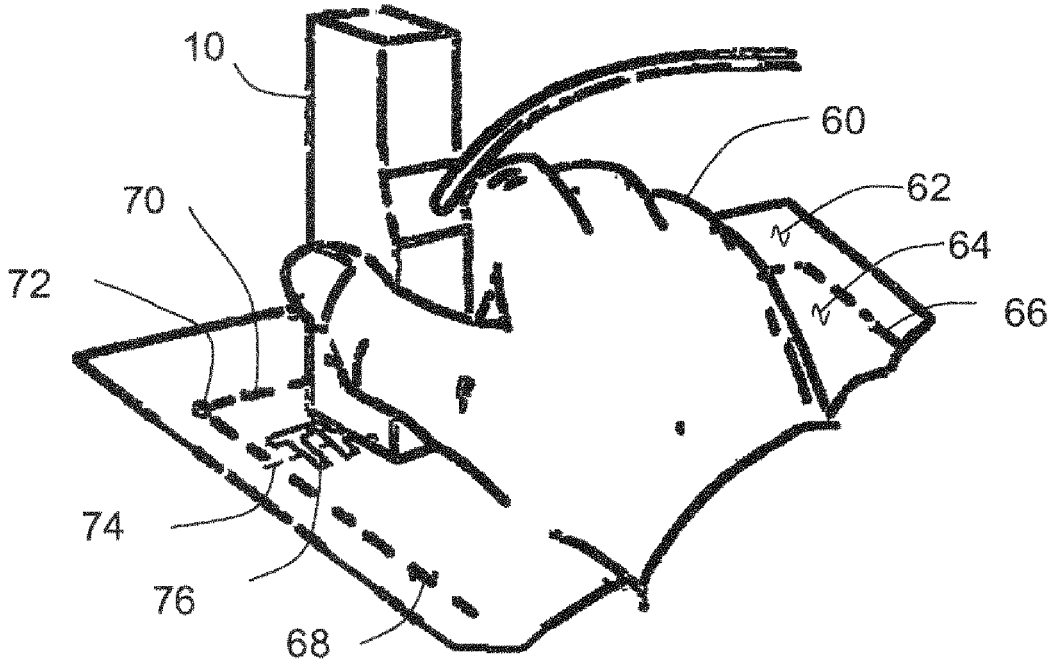
FIG. 2 is a perspective of a hand-held micro-fluid ejection device in operation.

FIG. 2 presents an illustration of the printing apparatus 10 in operation. A hand 60 of an operator is moving printing apparatus 10 over a substrate surface 62. There is a target area 64 on the substrate surface 62, and the target area 64 is defined at least in part by boundary lines 66, 68 and 70. Boundary lines 68 and 70 define a coordinate origin 72 on the substrate surface 62. A horizontal reference axis 74 is established to define the intended path for printing information using the printing apparatus 10. A printed image 76 is shown.

It should be noted that in many embodiments the boundary lines 66, 68, and 70, as well as the coordinate origin 72 and the horizontal reference axis 74 may be virtual features that may established by the printing apparatus and may not be actually marked on the substrate surface 62. For example, the boundary lines 66, 68, and 70, as well as the coordinate origin 72 and the horizontal reference axis 74 may be explicitly or implicitly defined by the geometric arrangement established in the printing apparatus for how the printed image (e.g., 76) is to be formed by a pattern of droplets. In circumstances where, for example, a horizontal reference axis (e.g., 74) is not actually marked on a substrate surface (e.g., 62) but rather is explicitly or implicitly defined by the geometric arrangement established in the printing apparatus (e.g., 10) for how the printed image (e.g., 76) is to be formed by a pattern of droplets, the term "the substrate surface has a horizontal reference axis" means that a horizontal reference axis is explicitly or implicitly established in the printing apparatus.

It should be noted that while substrate surface 62 is depicted in FIG. 2 as substantially planar and boundary lines 66, 68, and 70, and horizontal reference axis 74 are depicted in a substantially orthogonal arrangement, in some embodiments a substrate surface may be curved or bent, and a boundary line and a horizontal reference axis may be curvilinear or generally irregular.

Figure 3A:
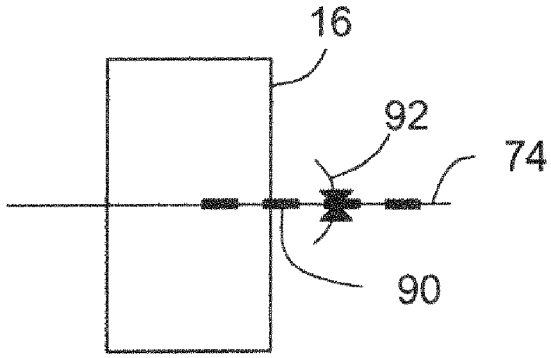
FIGS. 3A, 4A and 5A illustrate schematic top views of spatial orientations of a micro-fluid ejection head with respect to a substrate surface.
Figure 3B:
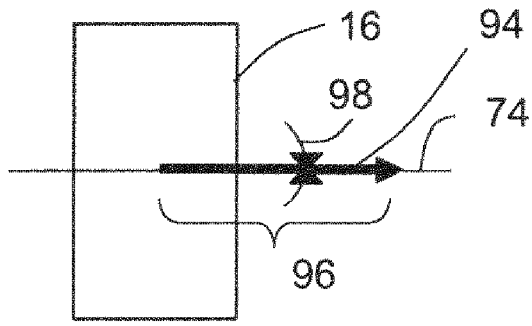
FIGS. 3B, 4B and 5B illustrate schematic top views of dynamic orientations of a micro-fluid ejection head with respect to a substrate surface.
Figure 4A:
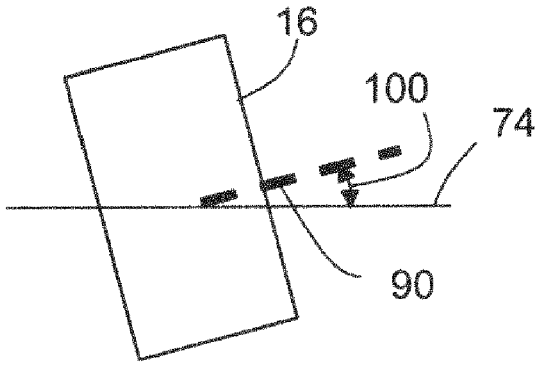
Figure 4B:
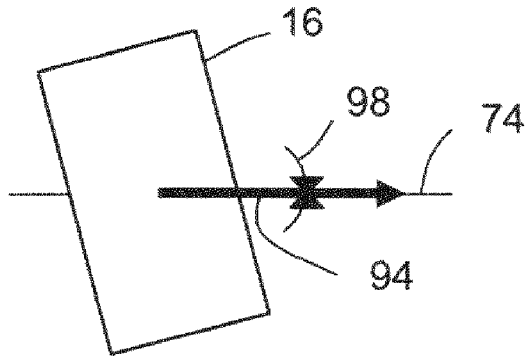
Figure 5A:
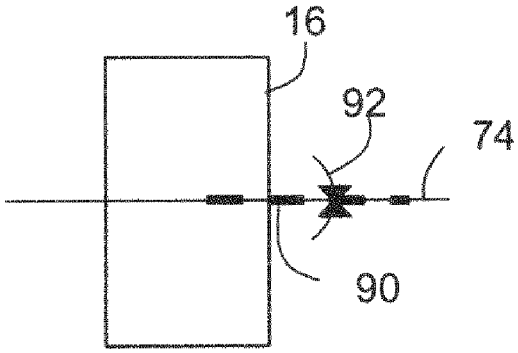
Figure 5B:
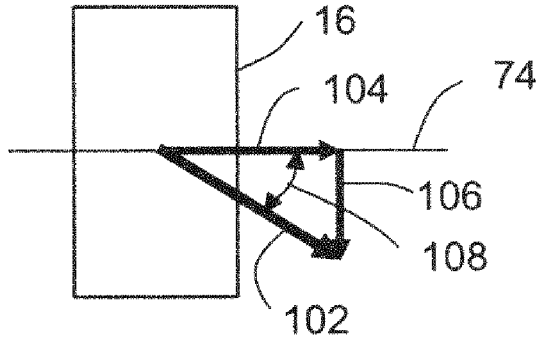

FIGS. 3A, 3B, 4A, 4B, 5A, and 5B illustrate various physical orientations between an ejection head and a substrate surface. Specifically, FIGS. 3A, 4A and 5A illustrate various physical spatial orientations, whereas FIGS. 3B, 4B, and 5B illustrate various physical dynamic orientations involving translational motion between an ejection head and a substrate surface. It is to be noted that at a time of translational or elevational motion between an ejection head and a substrate surface, the ejection head and the substrate surface have both a spatial orientation and a dynamic orientation. The spatial orientation refers to the relative geometric position of the ejection head with respect to the substrate surface at an instant in time. The dynamic orientation refers to the relative kinetic motion between the ejection head and the substrate surface at that instant in time.

FIG. 3A illustrates the ejection head 16 positioned on a horizontal reference axis 74 of a substrate surface. The ejection head 16 has a lateral alignment axis 90, which is defined as the direction along which the ejection head 16 should move to print accurately on horizontal reference axis 74. A lateral reference axis may be a physical feature incorporated in the printing apparatus. Alternatively, a lateral reference axis may be an indicator that is implied by the geometry of various features of the printing apparatus, such as the visual centerline of the ejection head. A rotation angle 92 is defined as the angle between the horizontal reference axis 74 and the lateral alignment axis 90 of the ejection head 16. In FIG. 3A the rotation angle 92 is substantially zero. Rotation angle 92 is an example of measured data indicative of an actual orientation between the ejection device and the substrate surface.

FIG. 3B illustrates the ejection head 16 moving along the horizontal reference axis 74 in a dynamic orientation having a velocity represented by velocity vector 94. The conventional standard for vectors is used herein, where velocity vector 94 has a direction indicated by its arrowhead and a magnitude represented by its length 96. A yaw angle 98 is defined as the angle between the horizontal reference axis 74 and velocity vector 94. In FIG. 3B the yaw angle 98 is substantially zero. Because the yaw angle 98 is substantially zero, the entire velocity vector 94 represents a horizontal velocity component (i.e., a component of a velocity vector that is parallel to the horizontal reference axis). Yaw angle 98, and velocity vector 94, and length 96 are examples of measured data indicative of an actual orientation between the ejection device and the substrate surface. It is to be noted that an acceleration vector could be substituted for the velocity vector 94 as a further illustration of a dynamic orientation between the ejection head 16 and a substrate surface. FIGS. 3A and 3B illustrate proper alignment and motion of ejection head 16 and horizontal reference axis 74 for accurate printing. That is, the rotation angle 92 and the yaw angle 98 are substantially zero.

FIG. 4A illustrates the ejection head 16 positioned on a horizontal reference axis 74 of a substrate surface, in a spatial orientation different from the spatial orientation in FIG. 3A. In FIG. 4A, the lateral alignment axis 90 of the ejection head 16 is at a rotation angle 100 that is not substantially zero. FIG. 4B illustrates the ejection head 16 moving along the horizontal reference axis 74 in a dynamic orientation having a velocity represented by velocity vector 94. The yaw angle 98 in FIG. 4B is substantially zero. The dynamic orientation of ejection head 16 may or may not be the same as the dynamic orientation of ejection head 16 in FIG. 3B, depending on such parameters as the acceleration of the ejection head 16 along horizontal reference axis 74 in FIG. 4B compared with FIG. 3B. FIGS. 4A and 4B illustrate non-optimal alignment of ejection head 16 and horizontal reference axis 74 for accurate printing. That is, the rotation angle 100 is not substantially zero.

FIG. 5A illustrates the ejection head 16 positioned on a horizontal reference axis 74 of a substrate surface, in the same spatial orientation shown in FIG. 3A. FIG. 5B illustrates the ejection head 16 moving along the horizontal reference axis 74 in a dynamic orientation having a velocity represented by velocity vector 102. Velocity vector 102 has a horizontal velocity component 104 and a vertical velocity component 106. The horizontal velocity component 104 and a vertical velocity component 106 are each separately considered to be an element of orientation between an ejection head and a substrate surface. The yaw angle 108 in FIG. 5B is not substantially zero. FIG. 5B illustrates non-optimal motion of ejection head 16 along horizontal reference axis 74 for accurate printing. That is, the yaw angle 108 is not substantially zero, or to state it differently, the vertical velocity component 106 is not substantially zero.

The present disclosure describes equipment and methods for hand-held printers (or other hand-held micro-fluid ejection devices) that minimize the potential negative impact of non-optimal ejection head orientations on print quality. In general, an electronic processor monitors selected operational parameters related to orientation (both spatial and dynamic) and blocks print whenever those parameters exceed orientation threshold limits. While this action might initially seem to be counterproductive, dealing with unprinted areas is consistent with the nature of a hand-held printer. For example, if an area of the page to be printed is missed or bypassed by the sweeping motion of the operator's hand, then a print quality defect or void remains on the paper until and unless the operator returns with the printer to repair the void. Adding void areas caused by print blocking to those caused by areas missed does not create an incremental usability challenge as hand-held printer design should generally enable returning the printer to those areas for repair.

Typically in the systems disclosed herein, navigation (the sensing & calculation of position on the page) continues even when printing is blocked. In this way the electronic processor remains continuously active and printing is restarted (unblocked) when operation returns within orientation threshold limits. With a hand-held printer, it is difficult to reacquire absolute position coordinates once navigation is lost. In a case where navigation is lost due to operational excess, the operator typically is notified by some means (indicator light, audio signal, etc) so the page can be restarted or (where possible) the absolute position coordinates may be manually reacquired and printing resumed.

As an example, consider the horizontal velocity component as an orientation that may be monitored and used to control print quality. In hand-held micro-fluid ejection devices, optical navigation requires sampling and processing large amounts of data to determine location. Faster speeds require processing more data for both navigation and print scheduling, so for a given computational capability, there will be a limit to how fast the printer may be moved. For example, a maximum speed of approximately eight in sec may be set as an orientation threshold limit above which printing is blocked. It is better to block printing before navigation fails (which, for example, may occur at ten in sec), so the operator may be notified that slower speeds are required.

As a further example, consider the yaw angle as an orientation that may be monitored and used to control print quality. Excessive yaw introduces inefficiency in hand-held printers because less area is swept by the ejection head as it is moved over the substrate surface. Vertical motion (i.e., +/−90° yaw) sweeps an area only a few pixels wide. To allow for yaw, the buffer of data for pixels to be printed grows rapidly in size as the yaw angle increases. In addition, excessive yaw may move a printer support over recently printed areas of the page which can be smeared by contact with the printer supports. For all these reasons, blocking print may be implemented whenever yaw angle exceeds an orientation threshold limit, such as approximately plus/minus thirty degrees. Note that vertical motion (yaw of 90°) is normal when moving the printer at the end of each hand swath, and printing then is probably not appropriate because of the probability of introducing print defects while changing direction.

Other print motion orientations such as rotation and acceleration may be monitored and printing blocked in a manner similar to that previously described for horizontal velocity and yaw angle. For example a plus/minus thirty degree maximum rotation angle may be established as an orientation threshold limit. To prevent mess and unintended damage, printing may be blocked by establishing an orientation threshold limit for the displacement between the ejection head and the substrate surface. As previously indicated, a proximity sensor may be used to estimate the displacement between the ejection head and substrate surface, and printing may be blocked based upon an orientation where the displacement exceeds the defined orientation threshold limit. That excess may be due to such factors as an irregular support under the paper as might be encountered when printing under adverse conditions such as on a plane or in a car where a flat surface is not available.

Implementation of orientation print blocking may be based on detection of an edge of the substrate surface where the printer would run off the substrate surface onto the underlying surface. Orientation print blocking may be used to prevent creating a mess that might result if printing is initiated in an unexpected print position (for example, at a starting location other than near in the upper left of the page), or if the printer is initially poorly aligned with the vertical axis of the paper.

In addition to orientation control, other operational limits may be similarly managed. For example, to avoid damage to the ejection head, printing may be blocked when sustained printing creates overheating at the micro-fluid ejection head.

It is noted that print blocking may be implemented as an optional function that may be turned off/on by the operator in a printer setup menu. For example, print blocking might be turned off for some parameters if a draft print mode is selected and turned on in better print quality modes. It is further noted that the operator may be unaware that print has been blocked during the job, so a means of notification may be implemented to alert the operator that repair will be required. If alerted whenever printing stops, the operator might return promptly to the place where printed stopped and make more accurate repairs. Various means for alerts are envisioned, including lights, sounds, vibration, and display.

Figure 6:
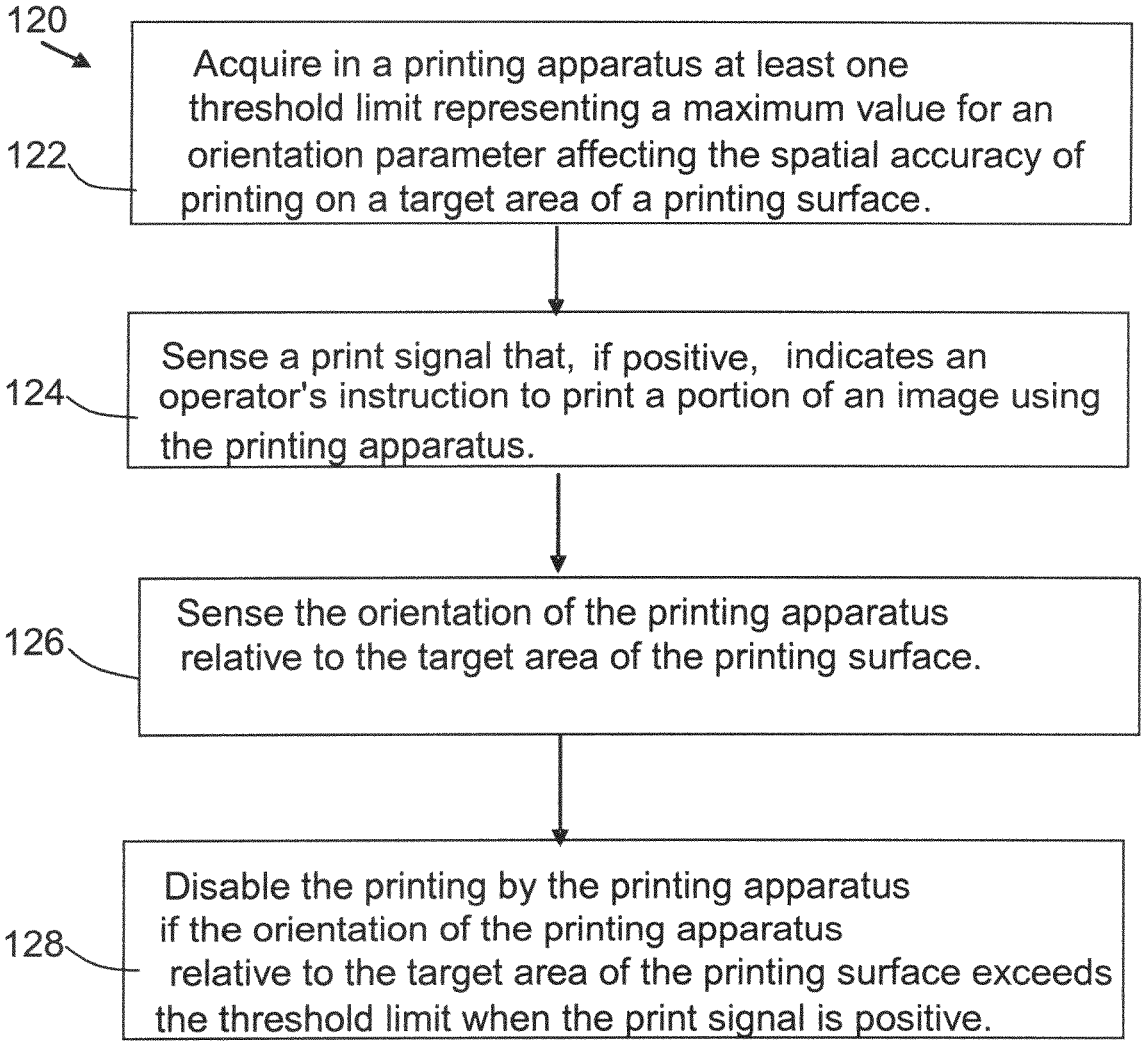
FIG. 6 presents a flow chart describing steps of certain methods disclosed herein.

FIG. 6 presents a flow chart 120 describing features of certain methods disclosed herein for controlling the geometric accuracy of printing using a hand-held printing apparatus. In step 122, at least one threshold limit representing a maximum value for an orientation parameter affecting the spatial accuracy of printing on a target area of a printing surface is acquired in a hand-held printing apparatus. In step 124, includes sensing a print signal that, if positive, indicates an operator's instruction to print a portion of an image using the hand-held printing apparatus. In step 126, the orientation of the hand-held printing apparatus relative to the target area of the printing surface is sensed. Then in step 128, the printing by the hand-held printing apparatus is disabled if the orientation of the hand-held printing apparatus relative to the target area of the printing surface exceeds the threshold limit when the print signal is positive. In some exemplary embodiments, printing may be resumed once the errant orientation of the hand-held printing apparatus relative to the target area of the printing surface conforms to threshold limit.

The foregoing descriptions of exemplary embodiments of disclosure have been presented for purposes of illustration and exposition. They are not intended to be exhaustive or to limit the disclosed embodiments to the precise forms disclosed. Obvious modifications or variations are possible in light of the above teachings. The embodiments are chosen and described in an effort to provide the best illustrations of the principles of the exemplary embodiments and their practical application, and to thereby enable one of ordinary skill in the art to utilize the disclosed embodiments with various modifications as are suited to the particular use contemplated. All such modifications and variations are within the scope of the exemplary embodiments as determined by the appended claims when interpreted in accordance with the breadth to which they are fairly, legally, and equitably entitled.

What is claimed is:

1. A hand-held micro-fluid ejection device for ejecting a fluid onto a substrate surface having a horizontal reference axis in a plurality of physical orientations between the ejection device and a substrate surface, the device comprising:

an ejection head having an enabled state for permitting the ejection of the fluid onto the substrate surface, a disabled state for blocking the ejection of the fluid onto the substrate surface and a velocity vector relative to the substrate surface, the velocity vector having magnitude relative to the substrate surface and a yaw angle relative to the horizontal reference axis;

a position sensor system for providing measured data indicative of at least one of the plurality of physical orientations between the ejection device and the substrate surface, the at least one of the plurality of physical orientations comprising a plurality of relative velocity vectors for the ejection head, each relative velocity vector having a velocity magnitude relative to the substrate surface and a yaw angle relative to the horizontal reference axis;

an electronic processor for receiving the measured data from the position sensor system and placing the ejection head in the disabled state if the measured data indicates that the at least one of the plurality of physical orientations of the ejection device exceeds an orientation threshold limit for the orientation between the ejection device and the substrate surface;

the measured data comprising a measured relative velocity vector, the measured relative velocity vector having a measured velocity magnitude relative to the substrate surface and a measured yaw angle relative to the horizontal ejection reference axis;

the orientation threshold limit comprising a plurality of maximum relative velocity vectors relative to the substrate surface and to the horizontal reference axis; and the electronic processor placing the ejection head in the disabled state if the measured relative velocity vector exceeds at least one of the plurality of maximum relative velocity vectors.

2. A hand-held micro-fluid ejection device for ejecting a fluid onto a substrate surface having a horizontal reference axis in a plurality of physical orientations between the ejection device and a substrate surface, the device comprising:

an ejection head having an enabled state for permitting the ejection of the fluid onto the substrate surface, a disabled state for blocking the ejection of the fluid onto the substrate surface and a velocity vector relative to the substrate surface, the velocity vector having a yaw angle relative to the horizontal reference axis;

a position sensor system for providing measured data indicative of at least one of the plurality of physical orientations between the ejection device and the substrate surface, the at least one of the plurality of physical orientations comprising a plurality of relative velocity vectors for the ejection head relative to the substrate surface, the relative velocity vectors having a yaw angle relative to the horizontal reference axis;

an electronic processor for receiving the measured data from the position sensor system and placing the ejection head in the disabled state if the measured data indicates that the at least one of the plurality of physical orientations of the ejection device exceeds an orientation threshold limit for the orientation between the ejection device and the substrate surface;

the measured data comprising a measured yaw angle of the ejection head velocity vector relative to the horizontal ejection reference axis;

the orientation threshold limit comprising a maximum yaw angle; and the electronic processor placing the ejection head in the disabled state if the measured yaw angle exceeds the maximum yaw angle.

3. A hand-held micro-fluid ejection device for ejecting a fluid onto a substrate surface having a horizontal reference axis in a plurality of physical orientations between the ejection device and a substrate surface, the device comprising:

an ejection head having an enabled state for permitting the ejection of the fluid onto the substrate surface, a disabled state for blocking the ejection of the fluid onto the substrate surface and a velocity vector relative to the substrate surface, the velocity vector having a magnitude relative to the substrate surface and a yaw angle relative to the horizontal reference axis;

a position sensor system for providing measured data indicative of at least one of the plurality of physical orientations between the ejection device and the substrate surface, the at least one of the plurality of physical orientations comprising a plurality of relative velocity vectors for the ejection head, each relative velocity vector having a velocity magnitude relative to the substrate surface and a yaw angle relative to the horizontal reference axis;

an electronic processor for receiving the measured data from the position sensor system and placing the ejection head in the disabled state if the measured data indicates that the at least one of the plurality of physical orientations of the ejection device exceeds an orientation threshold limit for the orientation between the ejection device and the substrate surface;

the measured data comprising a first set of position coordinates for the ejection head relative to the substrate surface measured at a first time and a second set of position coordinates for the ejection head measured at a second time;

the orientation threshold limit comprising a plurality of maximum relative velocity vectors relative to the substrate surface and to the horizontal reference axis; and the electronic processor comparing the first set of position coordinates with the second set of position coordinates to compute a measured relative velocity vector, the measured relative velocity vector having a measured velocity magnitude relative to the substrate surface and a measured yaw angle relative to the horizontal reference axis, and the electronic processor placing the ejection head in the disabled state if the measured relative velocity vector exceeds the maximum relative velocity vector.

4. A hand-held micro-fluid ejection device for ejecting a fluid onto a substrate surface having a horizontal reference axis in a plurality of physical orientations between the ejection device and a substrate surface, the device comprising:

an ejection head having an enabled state for permitting the ejection of the fluid onto the substrate surface, a disabled state for blocking the ejection of the fluid onto the substrate surface and a velocity vector relative to the substrate surface, the velocity vector having a yaw angle relative to the horizontal reference axis;

a position sensor system for providing measured data indicative of at least one of the plurality of physical orientations between the ejection device and the substrate surface, the at least one of the plurality of physical orientations comprising a plurality of relative velocity vectors for the ejection head relative to the substrate surface, each relative velocity vector having a yaw angle referenced to the horizontal reference axis;

an electronic processor for receiving the measured data from the position sensor system and placing the ejection head in the disabled state if the measured data indicates that the at least one of the plurality of physical orientations of the ejection device exceeds an orientation threshold limit for the orientation between the ejection device and the substrate surface;

the measured data comprising a first set of position coordinates for the ejection head relative to the substrate surface measured at a first time and a second set of position coordinates for the ejection head measured at a second time;

the orientation threshold limit comprising a maximum yaw angle; and the electronic processor comparing the first set of position coordinates with the second set of position coordinates to compute a measured yaw angle of the ejection head velocity vector relative to the horizontal reference axis and placing the ejection head in the disabled state if the measured data indicates that the measured yaw angle exceeds the maximum yaw angle.

* * * * *

UNITED STATES PATENT AND TRADEMARK OFFICE

CERTIFICATE OF CORRECTION

PATENT NO. : 7,661,814 B2
APPLICATION NO. : 11/459971
DATED : February 16, 2010
INVENTOR(S) : Noe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 614 days.

Signed and Sealed this

Twenty-eighth Day of December, 2010

David J. Kappos

David J. Kappos
*Director of the United States Patent and Trademark Office*